United States Patent [19]

Bishop

[11] 4,435,082

[45] Mar. 6, 1984

[54] ROTARY DRUM MIXING DEVICE

[76] Inventor: Robert J. Bishop, 1083 Bloomfield Ave., West Caldwell, N.J. 07006

[21] Appl. No.: 380,530

[22] Filed: May 21, 1982

[51] Int. Cl.[3] ..... B28C 5/18; B28C 5/20; B28C 7/16

[52] U.S. Cl. ..... 366/47; 366/57; 366/60; 366/63; 366/185; 366/228; 366/232

[58] Field of Search ..... 366/42, 44, 45–48, 366/53–59, 62, 63, 92, 93, 185, 60, 187, 200, 213, 220, 224–228, 232, 606

[56] References Cited

U.S. PATENT DOCUMENTS

| | | | |
|---|---|---|---|
| 603,227 | 4/1898 | Anderson | 366/232 |
| 1,863,029 | 6/1932 | Piispanen | 366/47 |
| 2,452,896 | 11/1948 | Bonney et al. | 366/47 |
| 2,478,408 | 8/1949 | Lightburn | 366/57 X |
| 2,573,296 | 10/1951 | Arant | 366/47 |
| 2,808,241 | 10/1957 | Beran, Jr. | 366/57 |

*Primary Examiner*—Timothy F. Simone
*Attorney, Agent, or Firm*—Howard E. Thompson, Jr.

[57] ABSTRACT

A light weight, inexpensive rotary drum mixing device is provided in which an essentially pear shaped drum, open at the small end and having an axially elongated socket protruding from the large end, is rotatably supported on a unitary base having a transversely extended forward end and an upwardly and angularly extending rear end providing a bearing portion detachably engageable with said socket to rotatably support the drum at an inclination of about 35°, readily engageable means on the bearing portion and socket for preventing unintended axial movement, the forward end of the frame being slightly forward of the center of gravity of the rotatably supported drum to firmly support the same as drum contents are being mixed by rotation of the drum, and providing a pivot fulcrum for tilting the assemblage to discharge contents of the drum, and means externally of the drum facilitating application of circumferential force to impart controlled rotation to the drum. The drum has a plurality of axially extending radial fins for lifting contents in rotation thereof and is preferably fashioned from molded plastic material either as a unitary body or as a plurality of interfitting sectors joined together at said ribs.

In its simplest form the device has protruding means circumferentially of the drum for hand engagement to impart rotary movement to the drum; but when the device is intended for repeated and extended use the drum base is preferably provided with a circumferential gear slidably engageable with the drive gear of mechanical drive means fixedly mounted to said frame, on support means integral with the frame and disposed above and parallel to said bearing portion.

26 Claims, 12 Drawing Figures

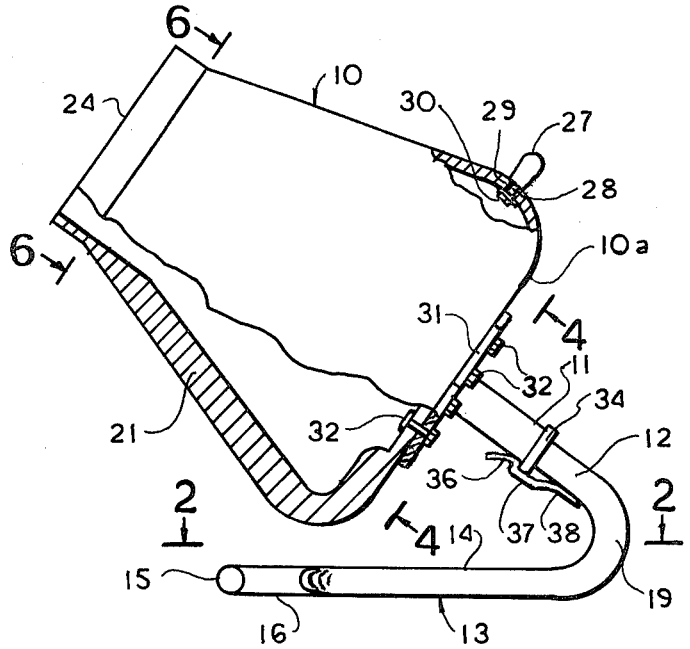
FIG. 1
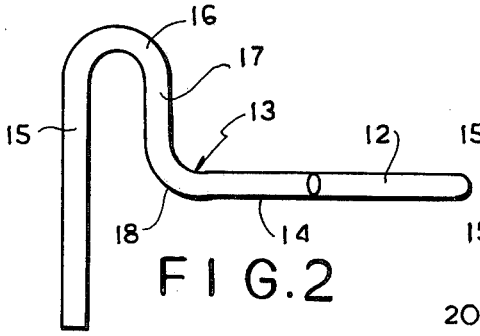
FIG. 2
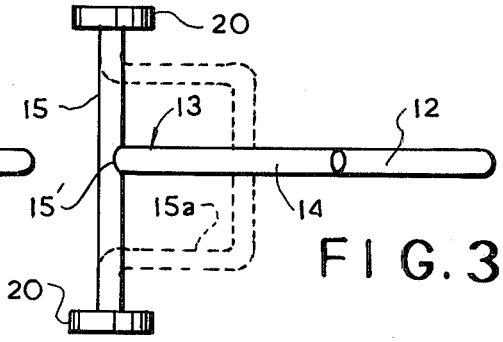
FIG. 3
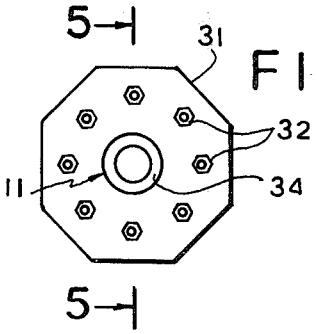
FIG. 4
FIG. 5
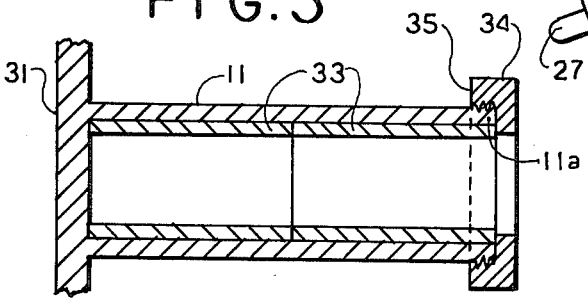
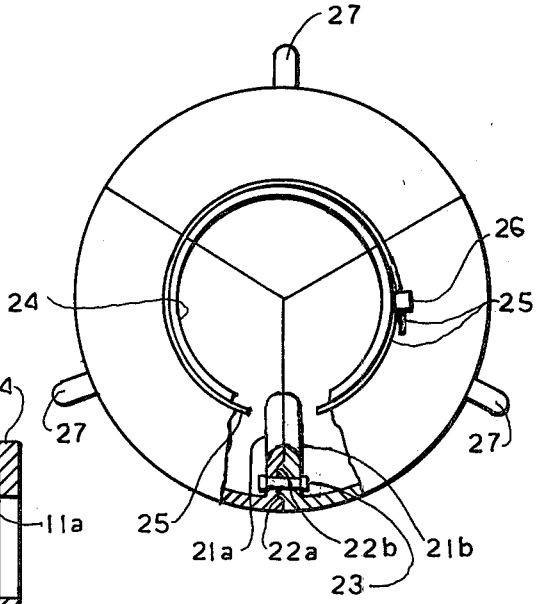
FIG. 6

FIG. 7
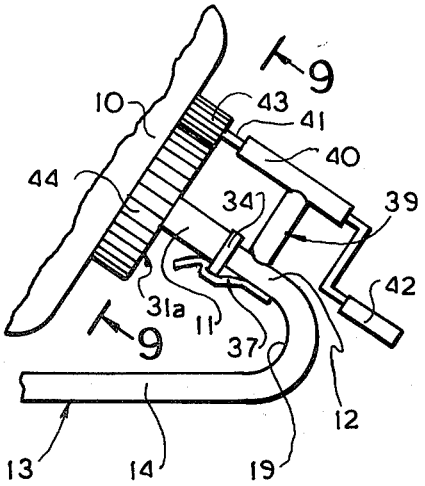
FIG. 8
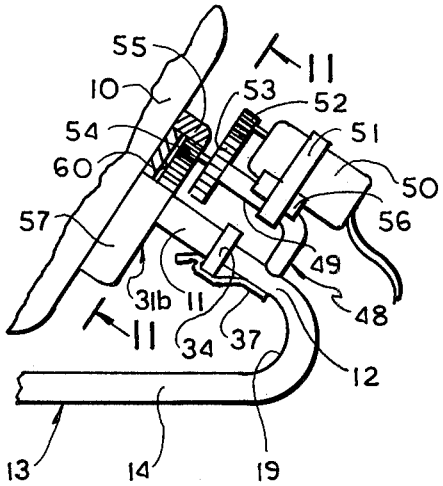
FIG. 9
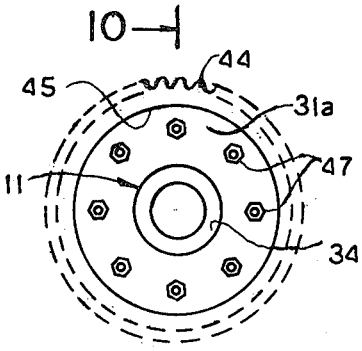
FIG. 11
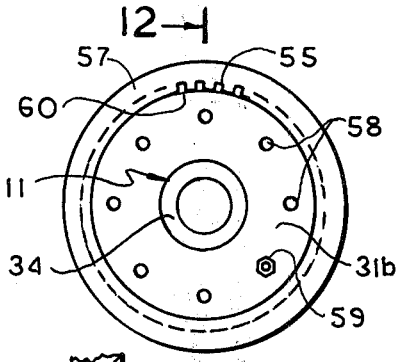
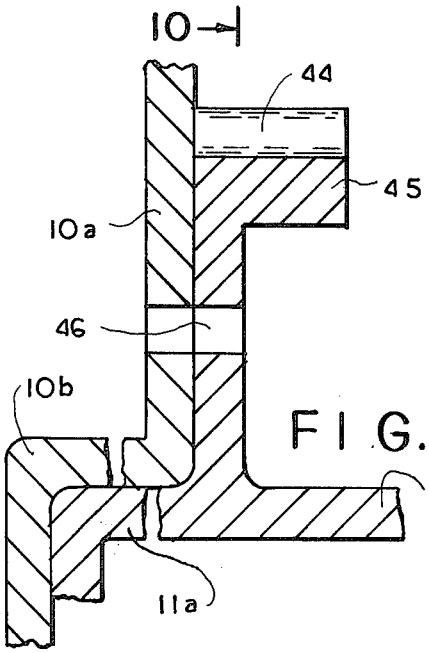
FIG. 10
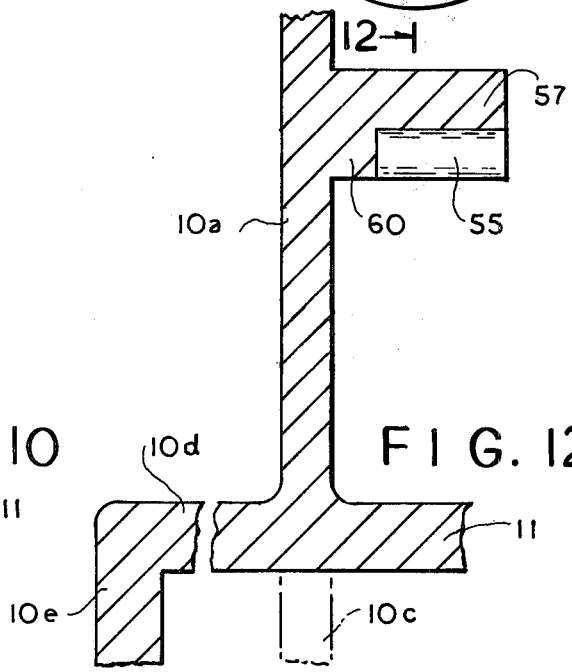
FIG. 12

ROTARY DRUM MIXING DEVICE

This invention relates to a light weight, inexpensive rotary drum mixing device in which an essentially pear shaped drum, open at the small end and having an axially elongated socket protruding from the large end, is rotatably supported on a unitary base having a transversely extended forward end and an upwardly and angularly extending rear end providing a bearing portion detachably engageable with said socket to rotatably support the drum at an inclination of about 35°, readily engageable means on the bearing portion and socket for preventing unintended axial movement, the forward end of the frame being slightly forward of the center of gravity of the rotatably supported drum to firmly support the same as drum contents are being mixed by rotation of the drum, and providing a pivot fulcrum for tilting the assemblage to discharge contents of the drum, and means externally of the drum facilitating application of circumferential force to impart controlled rotation to the drum. The drum has a plurality of axially extending radial fins for lifting contents in rotation thereof and is preferably fashioned from molded plastic material either as a unitary body or as a plurality of interfitting sectors joined together at said ribs.

In its simplest form the device has protruding means circumferentially of the drum for hand engagement to impart rotary movement to the drum; but when the device is intended for repeated and extended use the drum base is preferably provided with a circumferential gear slidably engageable with the drive gear of mechanical drive means fixedly mounted to said frame, on support means integral with the frame and disposed above and parallel to said bearing portion.

The mixer art, particularly as applied to cement mixers and the like, is known to be highly developed. The present invention relates to a limited segment of the mixer art, namely the relatively small size mixers which will handle, at one time, volumes of material to be mixed comparable to about 100 to 150 lbs. of a wet cement mixture. The device, in accordance with the present invention, is, therefore, particularly adapted to use by the homeowner in preparing small batches of cement, but this represents only a small segment of its potential utility as it can be used in many types of small batch mixing operations. It can be used, for example, in the blending of dry mixes such as tea and ground coffee blends, the dry ingredients for baked products and the like, as well as in the blending of fluid mixes such as in the blending of paint colors, fluid baking mixes and the like. It can also be used in the tumbling of small formed parts to remove burrs and achieve a degree of polish desired in such parts.

Based on applicant's long exposure to the mixer art and preliminary patent searches conducted to date, it is believed that the mixing device as herein disclosed involves a combination of simplicity and efficiency which is novel and patentable.

Regarded in certain of its broader aspects the mixing device, in accordance with the present invention, comprises a unitary frame having a base portion with a pivot fulcrum at the front end, an angularly, forwardly and upwardly extending bearing portion at the rear end, and a short connecting portion therebetween, the angularity of said bearing portion being about 35°, a generally pear shaped mixing drum closed and substantially flat at the large end, open at the small end, and having centrally of said closed end an elongated axial socket slidably engaging said bearing end of the frame to rotatably support said drum with its axis at said angle of approximately 35°, axially extending rib means on the inner surface of said drum for lifting contents in the rotation thereof, external means on said drum facilitating application of circumferential force to rotate the drum, the length of the connecting portion of said frame being such as to dispose said pivot fulcrum slightly forwardly of the center of gravity of the drum, readily engageable means on said bearing portion and socket to support the drum against axial movement when the assemblage is tilted around said fulcrum to discharge drum contents, said bearing portion being the only support for said drum, and said drum being readily removable from said frame upon disengagement of said last named means.

The pear shaped mixing drum, depending upon its intended use, can be fashioned from various materials such as metal, plastics, or even ceramic material; but is most suitably fashioned from molded plastic material such as high density polyethylene. It can be formed as a unitary cast or molded body or as a plurality of identical, interfitting sectors joined together at the rib portions of the drum.

The elongated axial socket at the enlarged closed end of the drum can be formed as an integral part of the drum or as a separate part having a mounting place for securing the same to the drum base. In either event the structure permits the user to readily grasp the drum at the open end and at the elongated axial socket for delivery of drum contents from a point of mixing to a point of use.

The simple frame base serves the multiple purpose of rotatably supporting the drum at a desired angle of inclination, suitably about 35°, providing stability during the mixing operation, and properly aligning mechanical drive means, if present, for slidable engagement with circumferential gear means on the drum base, while facilitating, by reason of the pivot fulcrum being located slightly forwardly of the center of gravity of the drum, easy tilting of the assemblage to discharge drum contents.

In its simplest form the base frame comprises a unitary piece of tubing extending from a front portion through a "U" bend to a parallel section approximately one half the length of the front portion, then through an "L" bend to a connecting portion perpendicular to the front portion and then through an upward and forward bend perpendicular to the plane of said front and connecting portions terminating in the bearing portion which slidably and rotatably engages the socket portion of the drum.

In a slightly more expensive form of base an elongated piece of tubing forming the front portion has welded at the mid portion thereof a perpendicularly disposed tubing providing the connecting portion and having the rear end bent upwardly and forwardly in a plane perpendicular to the plane defined by the front and connecting portions and terminating in a bearing portion as above-mentioned. This form of base lends itself to the mounting of wheels at the ends of the front portion, if desired, to facilitate movement of the drum-base assemblage.

With either type of base above-described, mounting means for a mechanical drive mechanism is readily provided by welding to the upwardly extending portion of the base a member providing apparatus support means oriented above, and parallel to, the bearing portion of the base frame. Such member, if intended to support a hand actuated drive mechanism, is suitably of T-shaped configuration with the crosshead parallel to the bearing portion of the base frame and providing means for rotatably supporting a hand crank carrying a gear to mesh with the gear on the drum base.

When said member is intended to support a motor drive mechanism it can suitably comprise a tubular part of "L" shaped configuration having an open ended portion of substantial length parallel to said bearing portion. Such open ended portion provides both mounting means for an electric motor carrying a small gear, and rotatable support of a compound gear having axially spaced large gear and small gear portions, with the large gear portion meshing with the motor gear and the small gear portion slidably engageable with the gear means on the drum.

In such motor driven assemblage the gear sizes should be selected to convert the particular r.p.m. of the electric motor to a drum speed of approximately 18 r.p.m. By way of illustration, when using an electric drill type motor having an operating speed of about 550 r.p.m., the appropriate speed reduction is provided by employing a 1-inch gear on the motor shaft engaging a 4-inch gear on the motor mount carrying a coaxial 1-inch gear engaging an approximately 8-inch gear on the drum.

The gear means on the drum can be formed in the fabrication of the drum or provided by a separate member attached to the drum, and can be either an external gear or an internal gear on a part protruding from the drum. When the mechanical drive is of the hand crank type an external gear on the drum will be quite satisfactory. From the standpoint of safety, when employing a motor actuated drive mechanism, it is preferable to employ on the drum an axial extension carrying an internal gear and to secure appropriate gear shielding to the motor mount.

Novel features of the present invention will be more readily understood from a consideration of the following description having reference to the accompanying drawing, in which preferred adaptations of the invention have been illustrated with the various parts thereof identified by suitable reference characters in each of the views, and in which:

FIG. 1 is a side elevation view of a rotatable mixer and support base with part of the structure broken away and in section.

FIG. 2 is a view of the base as seen in the direction of the arrows 2—2 in FIG. 1.

FIG. 3 is a view similar to FIG. 2 showing a modified base construction.

FIG. 4 is a fragmentary view taken substantially on the line 4—4 of FIG. 1.

FIG. 5 is a fragmentary sectional view substantially on the line 5—5 of FIG. 4.

FIG. 6 is an end view of a mixer taken in the direction of the arrows 6—6 in FIG. 1 and showing a modified form of construction.

FIG. 7 is a fragmentary view of the assemblage shown in FIG. 1 illustrating structure facilitating mechanical hand rotation of the mixer.

FIG. 8 is a view similar to FIG. 7 illustrating structure facilitating mechanical motor driven rotation of the mixer.

FIG. 9 is an enlarged view of a portion of the structure shown in FIG. 7 taken substantially on the line 9—9 of FIG. 7.

FIG. 10 is a fragmentary sectional view taken substantially on the line 10—10 of FIG. 9 and showing a modified structure.

FIG. 11 is a fragmentary sectional view taken substantially on the line 10—10 of FIG. 8.

FIG. 12 is a fragmentary sectional view taken substantially on the line 12—12 of FIG. 11 and showing a modified structure.

As shown in the drawing the mixer, in accordance with the present invention, comprises a generally pear shaped drum 10 rotatably engaging, via an axially extending socket 11, the bearing portion 12 of a support base 13. The bearing portion 12 is upwardly and forwardly inclined at an angle of about 35° with respect to a connecting portion 14 which joins the bearing portion 12 to a transversely disposed member 15 positioned slightly forwardly of the center of gravity of the drum 10, and functioning as a pivot fulcrum when tipping the assemblage to discharge drum contents.

The base 13 in its simplest form comprises a unitary piece of tubing with a "U" bend 16, short portion 17 and "L" bend 18 disposing the connecting portion 14 perpendicularly to the transversely disposed member 15. The reverse bend at 19 positions the bearing portion 12 in a plane aligned with the connecting portion 14 and perpendicular to the plane defined by the connecting portion 14 and transverse member 15.

In the modified structure shown in FIG. 3 the transverse member 15 comprises a separate tubular part welded at its mid point 15' to the connecting portion 14 of the base frame. This structure facilitates the mounting of wheels 20 at ends of the transverse member 15 if desired to facilitate moving the drum-support base assemblage from place to place.

The drum 10 is provided with three or more inner axially and radially extending ribs 21 at equally spaced intervals circumferentially of the drum. The ribs 21 can be independent members secured to a preformed drum but, as illustrated in FIG. 1, preferably comprise integral molded or cast parts of the drum.

In this connection the drum, depending upon the type mixing for which it is intended, can be fashioned from various materials such as metals, plastics or even ceramic material. From the standpoint of ease of fabrication, light weight durability, and ease of cleaning and maintenance, the drum is suitably fashioned from plastic materials, with high density polyethylene being particularly advantageous for many uses.

The drum 10 can be fashioned as a unitary body or alternatively can be fashioned as a plurality of interfitting sectors joined together at portions forming the ribs 21.

FIG. 6 illustrates such a composite structure involving three sectors in which the rib forming portions 21*a*, 21*b* have aligning offsets 22*a*, 22*b*, and are secured together by suitable bolts 23. Because the ribs 21 terminate short of the open end 24 of the drum it is desirable in the composite structure to reinforce the open end as by means of a ring clamp 25 with screw tightening means 26.

To better visualize the size of the assemblage shown in FIG. 1 the drum 10 has a maximum diameter of about 22 inches, an axial length of about 22 inches, and a diameter at the open end 24 of about 11 inches imparting to the drum its essentially pear shaped contour. With a drum of this size, and a socket portion 11 extending 5 to 6 inches beyond the end of the drum, the assemblage can readily handle the blending of as much as about 120–140 lbs. of a wet cement mixture.

Various means can be provided externally of the drum 10 for applying circumferential force facilitating rotation of the drum in mixing drum contents. As shown in the drawing the drum 10 is provided with three projecting knobs 27 equally spaced circumferentially of the large portion of the drum and secured to the drum by threaded studs 28 extending through drum apertures 29 engaging nut and washer means 30 internally of the drum. It will be understood, however, that the projecting knobs 27 represent but one of many ways in which hand gripping of the drum to rotate the same can be facilitated; and it is within the scope of the invention to provide any desired type of surface irregularity to facilitate hand gripping as integral portions of the cast or molded drum.

While the socket 11 can be formed as an integral part of the case or molded drum 10, it preferably comprises a central extension of an enlarged mounting plate 31 secured to the wide end 10A of the drum by circumferentially spaced bolts 32.

As shown in FIG. 5 the socket 11 is preferably of sufficiently larger diameter than the bearing portion 12 of the base to receive one or more cylindrical antifriction sleeves or liners 33. The sleeves 33 can be made of bearing metal or other wear resistant materials, including certain plastic materials such as Teflon. The one or more sleeves 33 are secured in place by a threaded ring 34 secured to the end 11A of the socket and protruding radially therefrom as seen at 35.

The radial protrusion 35 is engaged by the movable end 36 of a spring member 37 welded or otherwise fixedly secured at its other end 38 to the bearing portion 12. This engagement by the spring member 37 prevents unintended axial movement of the socket 11 with respect to the bearing portion 12 as for example when tilting the assemblage around the pivot fulcrum formed by the transverse member 15 to discharge drum contents. It will be apparent, however, that this engagement is easily released by outward flexure of the spring member 37 to permit separation of the drum 10 from the supporting base 13 when desired. In this connection it will be noted that the user, by grasping the drum at the open end 24 and socket 11, can readily carry the drum from place to place to discharge contents where needed.

While the assemblage as described in connection with FIGS. 1 to 6 in which rotation of the drum is effected by hand application of rotary force to the drum will be adequate for most homeowners and others having limited to infrequent mixing needs, it is desirable, when more extensive use is contemplated, to provide mechanical means for imparting rotary movement to the drum. The basic simplicity of the assemblage lends itself to easy modification to accommodate either hand actuated or motor actuated mechanical drives as illustrated in FIGS. 7 to 12. In these modified showings it will be noted that changes are made primarily in the mounting plate 31 and the provision of supplemental support means on the bearing portion 12; and unaltered parts of the drum 10 and support frame 13 are identified by the reference characters used in FIGS. 1 to 6.

In the FIG. 7 modification the bearing portion 12 of the base frame 13 has welded thereto a "T" shaped extension 39 with the crosshead 40 disposed above and parallel to the bearing portion 12 and rotatably supporting a shaft 41 having a hand crank 42 at one end thereof and a small gear 43 at the other end meshing with a larger external gear 44 on the drum. The gears 42 and 43 are retained in aligning engagement by cooperation of the spring clamp 37 with the socket extension 35, but release of spring clamp 37 permits axial disengagement of the gears.

A suitable drum rotation speed is about 15 to 20, and preferably about 18 revolutions per minute which equates to 3 to 4 seconds per revolution. With a comfortable hand crank speed being about 1 to 1.5 revolutions per second this means that the relative size of the gears 44 and 43 respectively should be in the range of 3:1 to 6:1.

A typical gear arrangement within the range would be an 8 inch gear 44 meshing with a 2 inch gear 43, requiring the axis of the crosshead 40 of "T" extension 39 to be spaced 5 inches from the axis of the bearing portion 12. With other gear sizes, however, the spacing of these axes will be adjusted according to the fraction (pitch diameter 43+44/2.

While the gear 44 can be an integrally cast or molded part of the drum 10, it is preferably formed as part of a modified mounting plate 31*a* carrying the socket 11. As shown in FIGS. 9 and 10 the gear 44 is fashioned as an annular flange 45 on mounting plate 31*a* outwardly of apertures 46 for receiving bolts, rivets, or other fasteners 47 securing the mounting plate 31*a* on to the drum 10.

The mounting plate 31*a* can be flush with the drum bottom 10*a* as shown in FIG. 5 or can be provided with an extension 11*a* coaxial with the socket 11 interfitting with a closed end tubular extension 10*b* on the drum bottom. With this construction the bearing portion 12 of the base frame 13 will be appropriately lengthened to engage the elongated socket 11–11*a*. The purpose of the inner extension 11*a* of the socket and the accommodating inner extension 10*b* of the drum is to provide bearing support at a point closer to the center of gravity to the rotating drum and contents.

With addition of the inner socket extension 11*a* the length of the socket 11 can be somewhat reduced if desired. It is preferable, however, that the socket 11 protrude sufficiently beyond the outer surface of mounting plate 31*a* to facilitate grasping of the partially filled drum in moving it from place to place when detached from the base 13.

It will be understood that the modifications shown in FIG. 10, involving the inner socket 11*a* and inner drum extension 10*b*, can be employed, if desired, in the structure shown in FIGS. 1, 4 and 5. In this connection it should be borne in mind that the desirability of the inner extension of the socket 11*a* and drum bottom 10*b* increases with increase in the weight of material intended to be mixed in the drum. For the blending of coffee grounds, tea and other light weight materials, the flat drum bottom 10*a* and outwardly extending socket 11 shown in FIGS. 1, 4 and 5 is entirely satisfactory. In mixers intended for mixing cement and other heavy materials, however, it is preferable to include the inwardly extending socket part 11*a* and the accommodating inward extension 10*b* on the bottom.

In the modification shown in FIG. 8 the bearing portion 12 of the base frame 13 has welded thereto an "L" shaped extension 48 with the elongated tubular free end 49 thereof disposed above and parallel to the bearing portion 12. The free end 49 of the extension provides a motor mount to which an electric motor 50 is secured by strapping 51 or other suitable mounting means. The motor 50 is preferably in vertical alignment with the bearing portion 12 and extension end 49, and carries a small gear 52 meshing with a larger gear 53 rotatably mounted in the tubular extension end 49. The gear 53 carries a coaxial smaller gear 54 which meshes with a larger internal gear 55 on the drum 10.

Bearing in mind that a drum rotation of 15 to 20 and preferably about 18 r.p.m. is desired, the selection of appropriate gear sizes will depend on the r.p.m. of the motor bearing used. By way of illustration, with an electric drill type motor having a speed of 550 r.p.m. an appropriate speed reduction is provided with a 1 inch gear 52 meshing with a 4 inch gear 53 and a 1 inch gear 54 meshing with an 8 inch internal gear 55. Such a selection of gear sizes would require the axes of the tubular end 49 of extension 48 and the bearing portion 12 to be spaced about 3½ inches, and depending on the size of motor 50 an appropriate aligning spacer 56 should be clamped between the motor 50 and tubular extension 49 to properly mesh gears 52 and 53.

The selection of gear sizes can be widely varied, particularly in adapting the structure to different r.p.m. motors, and it should be borne in mind that critical factors in any such variation will be the axial spacing of tubular extension 49 and bearing portion 12 and the size of spacer 56 to properly mesh gear 52 and 53 while providing proper clearance between gear 53 and the socket portion 11.

While gear 55 can be an integrally cast or molded part of the drum 10, it is preferably formed as part of a modified mounting plate **31*b* carrying the socket 11. As shown in FIG. 11 the gear 55 is fashioned as an annular flange 57 on mounting plate 31*b* outwardly of apertures 58 for receiving bolts, rivets, or other fasteners 59 securing the mounting plate 31*b* to the drum 10. Note that the annular flange 57 should include an inner offset 60 adjacent the mounting plate 31*b* to axially space the gear teeth 55 from the fasteners 59**.

In FIG. 12 the gear 57 and the socket 11 have been shown as integrally cast or molded parts of the drum bottom **10*a*. The drum bottom can be flat as shown at dotted lines 10*c* providing only an outwardly extending socket 11; or the socket can be extended inwardly by offsetting the drum bottom as shown at 10*d* terminating in a closed end 10*e***. As earlier discussed such inner socket extension can be desirable in some instances to provide bearing support at a point closer to the center of gravity of the drum and contents.

With the motorized modification of FIG. 8 it would be desirable from the standpoint of safety to include a detachable cover, not shown, secured to the motor 50 and enveloping gear 52 and the upper portion of gear 53 while not interfering with the movement of annular flange 57 carrying gear 55.

As with the modifications earlier described the gears 54 and 55 are axially disengaged as the spring clamp 37 is released and the socket 11 is disengaged from the bearing portion 12.

A special advantage of the readily disengageable drum and base constructions herein disclosed is the compactness of packing for shipment which is facilitated. It will be noted in this connection that when the drum is detached from the base and the bearing portion 12 inserted into the open end of the drum the reoriented parts can be stored in a container only slightly larger than the drum.

The compactness of storage can be further enhanced by modifying the base structure as indicated in the dotted lines showing **15*a* in FIG. 3. In addition, when employing a structure embodying socket 11 on a detachable mounting plate 31, 31*a* or 31*b***, the mounting plate and fasteners can be supplied detached for easy assemblage by the consumer thereby permitting a further reduction in the size of the shipping container.

Various changes and modifications in the mixing device as herein disclosed may occur to those skilled in the art; and to the extent that such changes and modifications are embraced by the appended claims, it is to be understood that they constitute part of the present invention.

I claim:

1. A mixing device comprising a unitary frame extending front to rear of the device, said frame having a base portion with a transverse member forming the front end of said frame and providing a pivot fulcrum at said front end, a short connecting portion joined to said transverse member, said connecting portion terminating in an angularly, forwardly and upwardly extending portion providing a bearing portion at the rear end of said frame, the angularity of said bearing portion being about 35+ with respect to the plane of said base portion, a generally pear shaped mixing drum providing large and small ends, said drum being closed and substantially flat at the large end and open at the small end, said closed end having an elongated axial socket, said axial socket slidably engaging said bearing end of the frame to rotatably support said drum with its axis at said angle of approximately 35°, axially extending rib means on the inner surface of said drum for lifting contents in the rotation thereof, external means of said drum facilitating application of circumferential force to rotate the drum, the length of the connecting portion of said frame being such as to dispose said pivot fulcrum slightly forwardly of the center of gravity of the drum, readily engageable and disengageable means on said bearing portion and socket to support the drum against axial movement when the assemblage is tilted around said fulcrum to discharge drum contents, said bearing portion being the only support for said drum, and said drum being readily removable from said frame upon disengagement of said last named means.

2. A mixing device as defined in claim 1, wherein the drum is fashioned from molded plastic material.

3. A mixing device as defined in claim 2, wherein the drum is fabricated as a unitary molded body.

4. A mixing device as defined in claim 3, wherein the drum is fabricated as a plurality of identical, interfitting sectors joined together at the rib portions of the drum.

5. A mixing device as defined in claim 1, wherein the base is a unitary piece of tubing extending from said front transverse member through a "U" bend to a parallel section approximately one-half the length of the front member, then through an "L" bend to a connecting portion perpendicular to the front member, and then through an upward and forward bend perpendicular to the plane of said front and connecting portions terminating in said bearing portion.

6. A mixing device as defined in claim 1, wherein the base is fashioned from an elongated piece of tubing forming said front member, having welded at the mid point thereof a perpendicularly disposed tubing providing the connecting portion, and having the rear end bent upwardly and forwardly in a plane perpendicular to the plane defined by the front and connecting portions and terminating in said bearing portion.

7. A mixing device as defined in claim 6, wherein ends of said front member are provided with small wheels having axes parallel to said front member.

8. A mixing device as defined in claim 1, wherein the large end of said drum has an enlarged gear, coaxial with respect to said socket, adapted for slidable engagement with the smaller drive gear of a mechanical drive mechanism mounted on said frame.

9. A mixing device as defined in claim 8, wherein the gear on the large end of said drum is an external gear.

10. A mixing device as defined in claim 8, wherein the gear on the large end of said drum is an internal gear on a circumferentially disposed and axially protruding portion of said drum.

11. A mixing device as defined in claim 8, wherein said drive gear is integral with a hand crank rotatably supported in the crosshead of a T-shaped extension secured to said frame and disposing said crosshead above, and essentially parallel to, the bearing portion of said frame.

12. A mixing device as defined in claim 8, wherein said frame has an upward extension disposing a tubular motor mount portion above and parallel to the bearing portion of said frame, an electric motor fixedly secured to said motor mount portion having a small gear meshing with a substantially larger gear rotatably mounted in said motor mount portion, said last named gear having an integral and coaxial small gear portion to provide the drive gear meshing with the gear on said drum.

13. A mixing device as defined in claim 12, wherein the gear sizes are selected to convert the particular r.p.m. of the electric motor to a drum speed of approximately 18 r.p.m.

14. A mixing device as defined in claim 13, wherein the electric motor is of the electric drill type having an operating speed of about 550 r.p.m. and a 1-inch gear on the motor shaft engages a 4-inch gear on the motor mount carrying a coaxial 1-inch gear engaging an approximately 8-inch gear on the drum to thereby provide a drum rotation speed of approximately 18 r.p.m.

15. A mixing device as defined in any one of claims 8 to 10, wherein the enlarged gear is an integral part of said drum.

16. A mixing device as defined in claim 1, wherein said elongated axial socket is an integral central extension perpendicular to an enlarged mounting plate secured to said large end of the drum.

17. A mixing device as defined in claim 16, wherein said mounting plate is circular and has at the periphery thereof an axial flange protruding in the direction of the free end of said socket; said flange having gear teeth circumferentially of one axial surface thereof.

18. A mixing device as defined in claim 17, wherein said gear teeth are on the outer surface of said flange.

19. A mixing device as defined in claim 17, wherein said gear teeth are on the inner surface of said flange.

20. A mixing device as defined in claim 1, wherein said socket protrudes several inches from the large end of said drum.

21. A mixing device as defined in claim 1, wherein said socket protrudes several inches from the large end of said drum and also extends several inches into the interior of said drum.

22. A mixing device as defined in claims 20 or 21, wherein said socket is formed integrally with said drum.

23. A mixing device as defined in claims 20 or 21, wherein said socket is part of a mounting plate secured to said drum.

24. A mixing device comprising a unitary frame extending front to rear of the device, said frame having a base portion with a transverse member formimng the front end of said frame and providing a pivot fulcrum at said front end, a short connecting portion joined to said transverse member, said connecting portion terminating in an angularly, forwardly and upwardly extending portion providing a bearing portion at the rear end of said frame, the angularity of said bearing portion being about 35° with respect to the plane of said base portion, a generally pear shaped mixing drum providing large and small ends, said drum being closed and substantially flat at the large end and open at the small end, said closed end having an elongated axial socket, said axial socket slidably engaging said bearing end of the frame to rotatably support said drum with its axis at said angle of approximately 35°, axially extending rib means on the inner surface of said drum for lifting contents in the rotation thereof, external means on said drum facilitating application of circumferential force to rotate the drum, drive means for imparting such circumferential force located above said bearing portion with the rotational axis thereof parallel to the axis of said bearing portion, an integral upwardly directed extension on said bearing portion perpendicular to the axis thereof, an offset portion at the upper end of said extension disposed parallel to the axis of said bearing portion and providing the sole support for said drive means, the length of the connecting portion of said frame being such as to dispose said pivot fulcrum slightly forwardly of the center of gravity of the drum, readily engageable and disengageable means on said bearing portion and socket to support the drum against axial movement when the assemblage is tilted around said fulcrum to discharge drum contents, said bearing portion being the only support for said drum, and said drum being readily removable from said frame upon disengagement of said last named means.

25. A mixing device as defined in claim 24 wherein the rotational axis of said drive means is hand actuated.

26. A mixing device as defined in claim 24 wherein the rotational axis of said drive means is power actuated.

* * * * *